US008776439B2

(12) United States Patent
Howington et al.

(10) Patent No.: US 8,776,439 B2
(45) Date of Patent: Jul. 15, 2014

(54) MODULAR DOOR SYSTEM FOR REFRIGERATED CASE

(75) Inventors: Larry C. Howington, Chesterfield, VA (US); Steven O. Stubblefield, Mechanicsville, VA (US)

(73) Assignee: Hill Phoenix, Inc., Conyers, GA (US)

( * ) Notice: Subject to any disclaimer, the term of this patent is extended or adjusted under 35 U.S.C. 154(b) by 484 days.

(21) Appl. No.: 12/797,246

(22) Filed: Jun. 9, 2010

(65) Prior Publication Data

US 2011/0302944 A1 Dec. 15, 2011

(51) Int. Cl.
*E05D 7/02* (2006.01)

(52) U.S. Cl.
USPC ..... 49/382; 49/381; 49/501

(58) Field of Classification Search
USPC ..... 49/381, 382, 398, 401, 402, 501; 16/221, 229, 230, 231, 232, 254, 257, 16/258, 259, 378, 379
See application file for complete search history.

(56) References Cited

U.S. PATENT DOCUMENTS

| | | | | | |
|---|---|---|---|---|---|
| 2,835,359 | A | * | 5/1958 | Boldt et al. | 49/402 |
| 3,177,989 | A | | 4/1965 | Chiaro | |
| 3,673,735 | A | | 7/1972 | Winsler et al. | |
| 3,729,603 | A | | 4/1973 | Foltz | |
| 4,001,972 | A | * | 1/1977 | Hurwitz | 49/380 |
| 4,127,765 | A | | 11/1978 | Heaney | |
| 4,145,844 | A | | 3/1979 | Kaspar | |
| 4,543,800 | A | | 10/1985 | Mawby et al. | |
| 4,548,049 | A | | 10/1985 | Rajgopal | |
| 4,578,902 | A | | 4/1986 | Niekrasz et al. | |
| 4,753,043 | A | | 6/1988 | Bockwinkel | |
| 4,905,347 | A | | 3/1990 | Wroth | |
| 5,113,628 | A | | 5/1992 | Richardson et al. | |
| 5,255,473 | A | * | 10/1993 | Kaspar et al. | 49/501 |
| 5,321,870 | A | | 6/1994 | Wada et al. | |
| 5,333,355 | A | | 8/1994 | Beswick et al. | |
| 5,636,484 | A | | 6/1997 | DeBlock | |
| 5,787,724 | A | | 8/1998 | Pohl et al. | |
| 6,029,411 | A | | 2/2000 | Richardson | |
| 6,148,563 | A | | 11/2000 | Roche et al. | |
| 6,209,265 | B1 | | 4/2001 | Banicevic et al. | |
| 6,393,768 | B1 | | 5/2002 | Roche et al. | |
| 6,401,399 | B1 | | 6/2002 | Roche et al. | |
| 6,406,108 | B1 | | 6/2002 | Upton et al. | |
| 6,820,952 | B2 | | 11/2004 | Austin et al. | |
| 7,213,375 | B2 | | 5/2007 | Morgan et al. | |
| 7,246,470 | B2 | | 7/2007 | Beyrle | |

(Continued)

OTHER PUBLICATIONS

Baydur 742 IBS material data sheet.*

*Primary Examiner* — Katherine Mitchell
*Assistant Examiner* — Catherine A Kelly
(74) *Attorney, Agent, or Firm* — Foley & Lardner LLP

(57) ABSTRACT

A modular door system is provided including at least one substantially transparent panel and a frame extending about a perimeter of the panel. The frame includes a pair of horizontal frame elements and a pair of vertical frame elements. One vertical frame element is configured to pivot about a pivot axis so that the other vertical frame element is movable between an open and a closed position. The modular door system further includes at least one receptacle disposed in the frame and a first cartridge removably receivable in the receptacle to facilitate pivoting the one vertical frame element about the pivot axis. The first cartridge is replaceable or interchangeable with at least a second cartridge. The cartridges may provide for the modular door system to be post-formation customized to change, add, or remove certain functionalities or features.

9 Claims, 7 Drawing Sheets

(56) References Cited

U.S. PATENT DOCUMENTS

| | | | |
|---|---|---|---|
| 7,318,321 | B2 | 1/2008 | Grassmuck et al. |
| 7,434,950 | B2 | 10/2008 | Whitney |
| 7,559,672 | B1 | 7/2009 | Parkyn et al. |
| 7,681,369 | B2 | 3/2010 | Soltesiz et al. |
| 7,744,252 | B2 | 6/2010 | Maxik |
| 7,752,822 | B2 | 7/2010 | Minelli |
| 7,856,770 | B2 | 12/2010 | Grassmuck et al. |
| 7,870,704 | B2 | 1/2011 | Riblier et al. |
| 7,891,154 | B2 | 2/2011 | Cording |
| 2004/0194388 | A1 | 10/2004 | Roche et al. |
| 2006/0059861 | A1 | 3/2006 | Grassmuck et al. |
| 2006/0103269 | A1 | 5/2006 | Artwohl et al. |
| 2007/0022667 | A1 | 2/2007 | Olofsson |
| 2008/0042537 | A1 | 2/2008 | Kim et al. |
| 2008/0122324 | A1 | 5/2008 | Bienick |
| 2008/0158858 | A1 | 7/2008 | Madireddi et al. |
| 2008/0211359 | A1 | 9/2008 | Borgstrom et al. |
| 2008/0259593 | A1 | 10/2008 | Reese |
| 2009/0071088 | A1 | 3/2009 | Viegas et al. |
| 2009/0072679 | A1 | 3/2009 | Avila et al. |
| 2009/0151265 | A1 | 6/2009 | Gillen |
| 2009/0288343 | A1 | 11/2009 | Romolo |
| 2010/0062152 | A1 | 3/2010 | Roche et al. |
| 2010/0068398 | A1 | 3/2010 | Roche et al. |
| 2010/0119705 | A1 | 5/2010 | Roche et al. |
| 2010/0139036 | A1 | 6/2010 | Romolo |
| 2010/0189571 | A1 | 7/2010 | Coonrod |
| 2010/0192468 | A1 | 8/2010 | Chubb et al. |
| 2010/0205991 | A1 | 8/2010 | Ernst et al. |
| 2011/0043089 | A1 | 2/2011 | Chubb et al. |
| 2011/0100044 | A1 | 5/2011 | Reichert et al. |
| 2011/0126561 | A1 | 6/2011 | Sunderland et al. |
| 2011/0302945 | A1 | 12/2011 | Howington et al. |
| 2011/0304252 | A1 | 12/2011 | Stubblefield |
| 2011/0304253 | A1 | 12/2011 | Howington et al. |
| 2011/0304254 | A1 | 12/2011 | Stubblefield |

* cited by examiner

FIGURE 6A
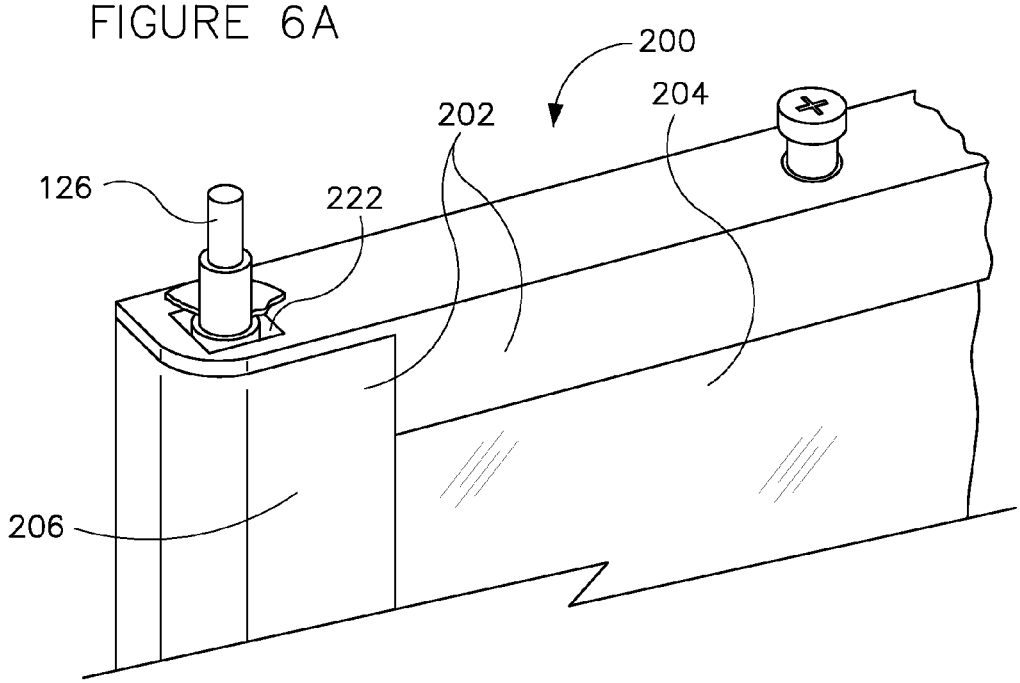
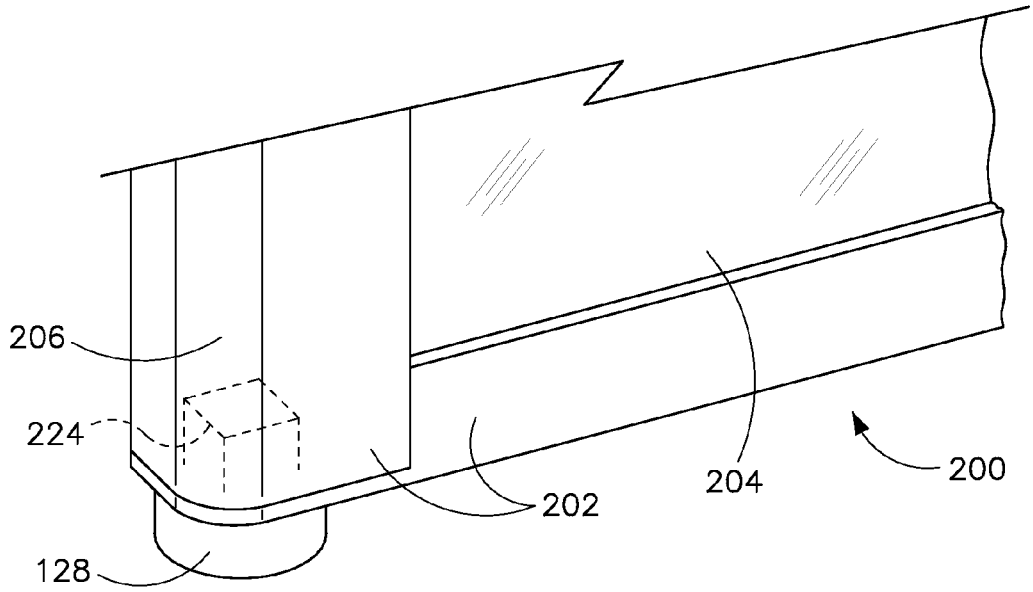
FIGURE 6B

MODULAR DOOR SYSTEM FOR REFRIGERATED CASE

BACKGROUND

The present invention relates generally to the field of doors. More specifically, the present invention relates to doors for temperature-controlled cases.

It is well known to provide doors for accessing goods stored or displayed in temperature controlled cases, such as a refrigerator, freezer, refrigerated merchandiser, refrigerated display case, etc., that may be used in commercial, institutional, and residential applications. However, conventional doors for temperature controlled cases are often difficult and time-consuming to replace or repair. Also, the functionality and features of conventional doors are often locked in once the door is formed.

An improved modular door system for a temperature-controlled case is provided.

SUMMARY

One embodiment of the invention relates to a modular door system for a refrigerated case that comprises a stepped glass unit and a frame extending about a perimeter of the glass unit. The frame includes a first horizontal frame element generally opposite a second horizontal frame element, and a first vertical frame element generally opposite a second vertical frame element. The first vertical frame element is configured to pivot about a pivot axis so that the second vertical frame element is movable between an open position and a closed position. The modular door system further comprises a first receptacle disposed in the first horizontal frame element and second receptacle disposed in the second horizontal frame element, the receptacles substantially aligned with the pivot axis, and a first cartridge and a second cartridge removably receivable in the first receptacle and the second receptacle and interchangeable therebetween. The frame may be converted between a right-handed orientation and a left-handed orientation by rotating the frame and panel 180 degrees and interchanging the position of the first cartridge and the second cartridge.

Another embodiment of the invention relates to a modular door system for a refrigerated case that comprises at least one substantially transparent panel and a frame extending about a perimeter of the panel. The frame including a pair of horizontal frame elements and a pair of vertical frame elements. One vertical frame element is configured to pivot about a pivot axis so that the other vertical frame element is movable between an open position and a closed position. The modular door system further comprises at least one receptacle disposed in the frame and a first cartridge removably receivable in the receptacle to facilitate pivoting one vertical frame element about the pivot axis so that the other vertical frame element is movable between an open position and a closed position. The first cartridge is replaceable or interchangeable with at least a second cartridge.

Another embodiment of the invention relates to a modular door system for a refrigerated case that comprises an exterior side generally opposite an interior side; a stepped glass unit including at least a first glass panel spaced apart and parallel to a second glass panel, the first glass panel generally defining the exterior side of the modular door system and being larger than the second glass panel; and a seamless, one-piece frame molded about the stepped glass unit and formed using a polymeric material. The frame supports the glass unit and provides an exposed glass unit surface area on the exterior side that is greater than on the internal side.

Another embodiment of the invention relates to a method of making a modular door system for a refrigerated case that comprises providing a stepped glass unit including at least a first glass panel spaced apart and parallel to a second glass panel. The first glass panel generally defines an exterior side of the modular door system and is larger than the second glass panel. The method further comprises providing a mold having an interior cavity; positioning the stepped glass unit into the interior cavity of the mold; injecting a polymeric material into the interior cavity of the mold using an injection molding process to form a one-piece, seamless frame extending about a perimeter of the stepped glass unit and at least one receptacle disposed in the frame; and removing the door from the mold.

BRIEF DESCRIPTION OF THE DRAWINGS

FIG. 6A is a partial, front perspective view of the modular door system according to an alternative exemplary embodiment.

FIG. 6B is a partial, front perspective view of the modular door system according to an alternative exemplary embodiment.

DETAILED DESCRIPTION

Referring to the FIGURES, various embodiments of a modular door system 100 for a temperature-controlled case are disclosed. The modular door system is configured to be post-formation customized (e.g., in the shop, in the field, etc.) to change, add, or remove certain functionalities or features to the modular door system. For example, the modular door system may be configured to allow for left-hand to right-hand conversion after formation, as will be discussed in more detail below. The modular door system is further configured to be easily repaired or replaced. Additionally, the modular door system may have a sleek, substantially all-glass appearance that allows viewing of the stored or displayed goods and/or may provide an improved thermal barrier or break between an interior of the temperature-controlled case and the surrounding environment, external to the temperature-controlled case. These benefits, as well as others, will be discussed in more detail below.

Figure 1:
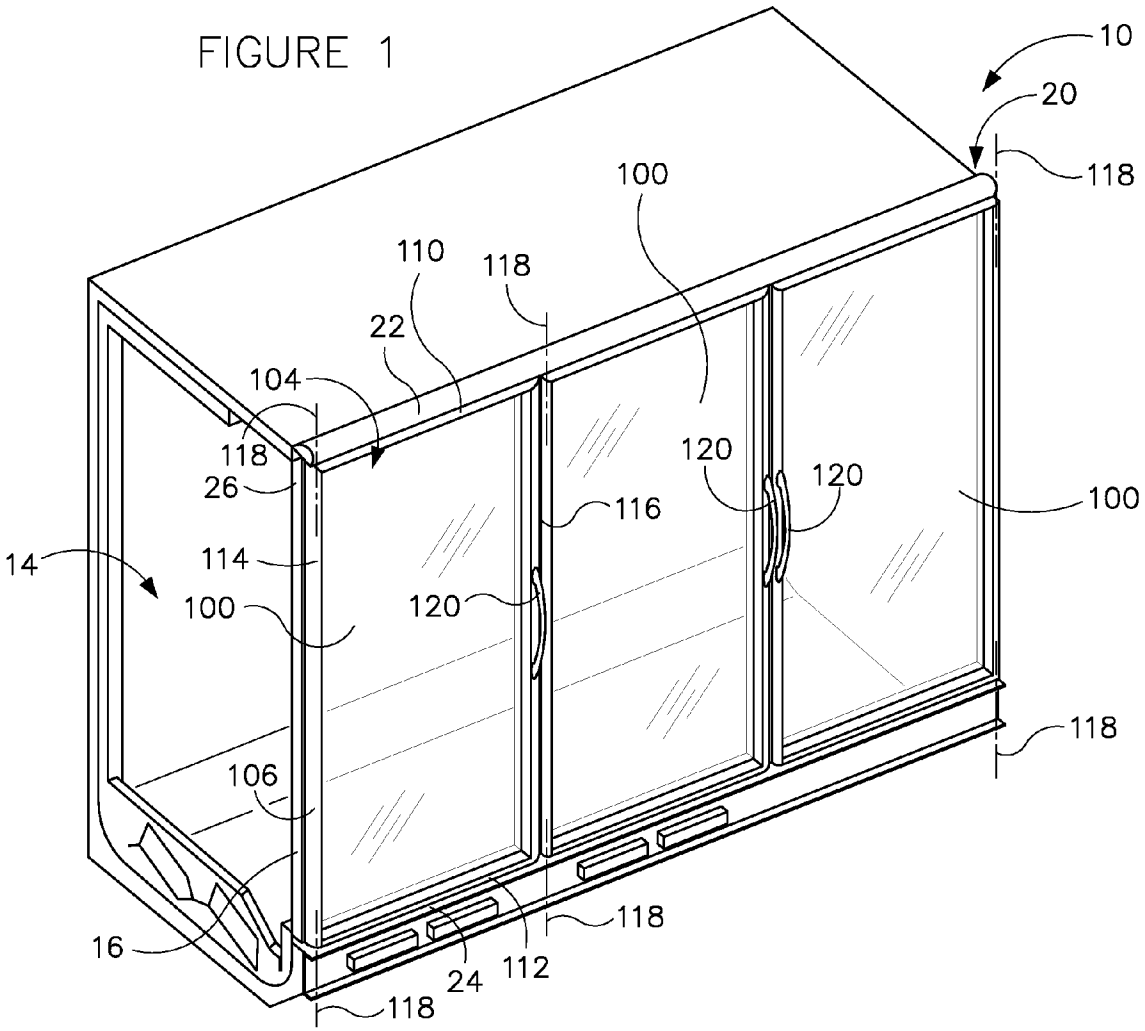
FIG. 1 is a front isometric view of a temperature-controlled case including a plurality of modular door system according to a first exemplary embodiment with a side wall removed.

Referring to FIG. 1, a plurality of modular door systems 100 are shown included in a temperature-controlled case, shown as a refrigerated case 10, according to an exemplary embodiment. The refrigerated case 10 is configured to store or display goods in an interior space or cavity 14 that is chilled or cooled to maintain the goods at a desired temperature. The modular door systems 100 allow a customer or other user to access the goods stored or displayed in the interior cavity 14 of the refrigerated case. Further, the modular door systems 100 act as a barrier between the environment external to the refrigerated case 10 and the interior cavity 14, helping to maintain the interior cavity 14 of the refrigerated case 10 at a desired temperature. While the refrigerated case 10 is shown as a straight case, the refrigerated case may be any temperature-controlled case that utilizes one or more doors to allow for access to goods stored or displayed there.

Figure 2A:
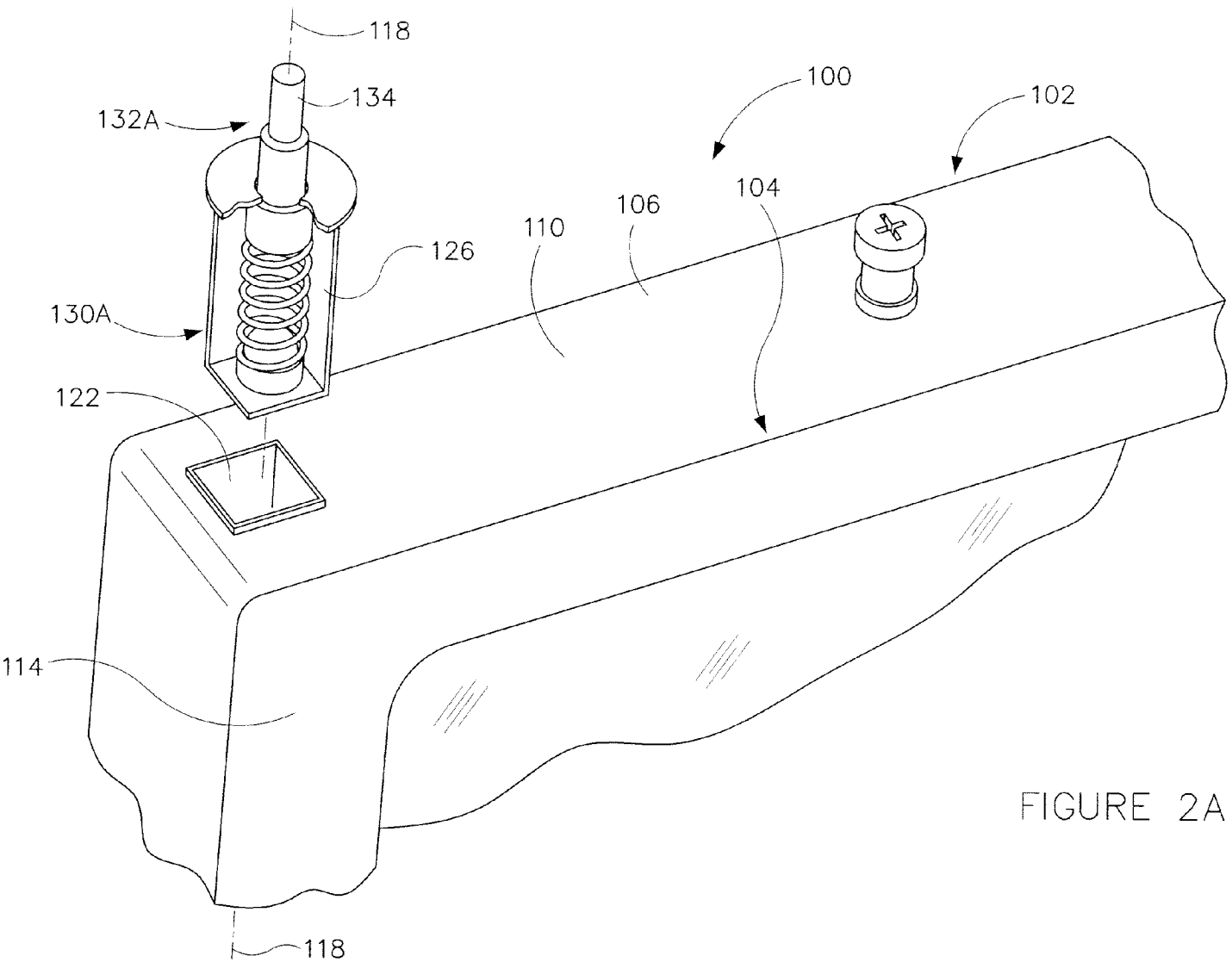
FIG. 2A is a partial isometric view of the modular door system according to the exemplary embodiment of FIG. 1.

The refrigerated case 10 includes a support structure shown as a refrigerated case frame 16 according to an exemplary embodiment. The refrigerated case frame 16 supports the modular door systems 100. At a front side 20 of the refrigerated case 10, the refrigerated case frame 16 includes at least one header 22, at least one sill 24, and a plurality of mullions 26 that define openings corresponding to the locations of the modular door systems 100. When coupled to the refrigerated case frame 16, an interior side 102 (see e.g., FIG. 2A illustrating the interior side 102) of the modular door system 100 faces the interior cavity 14 of the refrigerated case 10 and an opposing exterior side 104 faces away from the interior cavity 14.

Each modular door system 100 includes a door frame 106 having a first horizontal frame element 110 generally opposite a second horizontal frame element 112, and a first vertical frame element 114 generally opposite a second vertical frame element 116 according to an exemplary embodiment. The modular door system 100 is configured to be pivotally coupled to the refrigerated case 10 at the refrigerated case frame 16. The first vertical frame element 114 pivots about a pivot axis 118 so that the second vertical frame element 116 is movable between an open position and a closed position. When the modular door system 100 is in the closed position, it acts as a barrier or thermal break between the interior cavity 14 of the refrigerated case 10 and the surrounding environment. When the modular door system 100 is in the open position, a customer or other user is able to access the goods disposed in the interior cavity 14 of the refrigerated case 10.

Generally, the modular door systems 100 have either a left-handed orientation or a right-handed orientation. From the perspective shown in FIG. 1, in the left-handed orientation, the pivot axis 118 of the modular door system 100 is to the left of a handle 120 that facilitates moving the modular door system 100 between the open position and the closed position. In the right-handed orientation, the pivot axis 118 of the modular door system 100 is to the right of the handle 120. FIG. 1 shows two modular door systems 100 in a left-handed orientation and a third modular door system 100 in a right-handed orientation.

The handle 120 is coupled to a plate (e.g., a metal plate, a composite plate, etc.) disposed within the modular door system 100 according to an exemplary embodiment. The plate is configured to facilitate attaching and interchanging handles having a variety of configurations and aesthetic appearances. The handle may be coupled to the plate using fasteners or any other suitable coupling elements. Typically, the plate is positioned so that it is substantially not visible from the exterior of the door. According to other exemplary embodiments, the handle may be coupled to the modular door system in any suitable manner (e.g., adhered, welded, mechanically coupled to an element other than a plate, etc.).

Figure 2B:
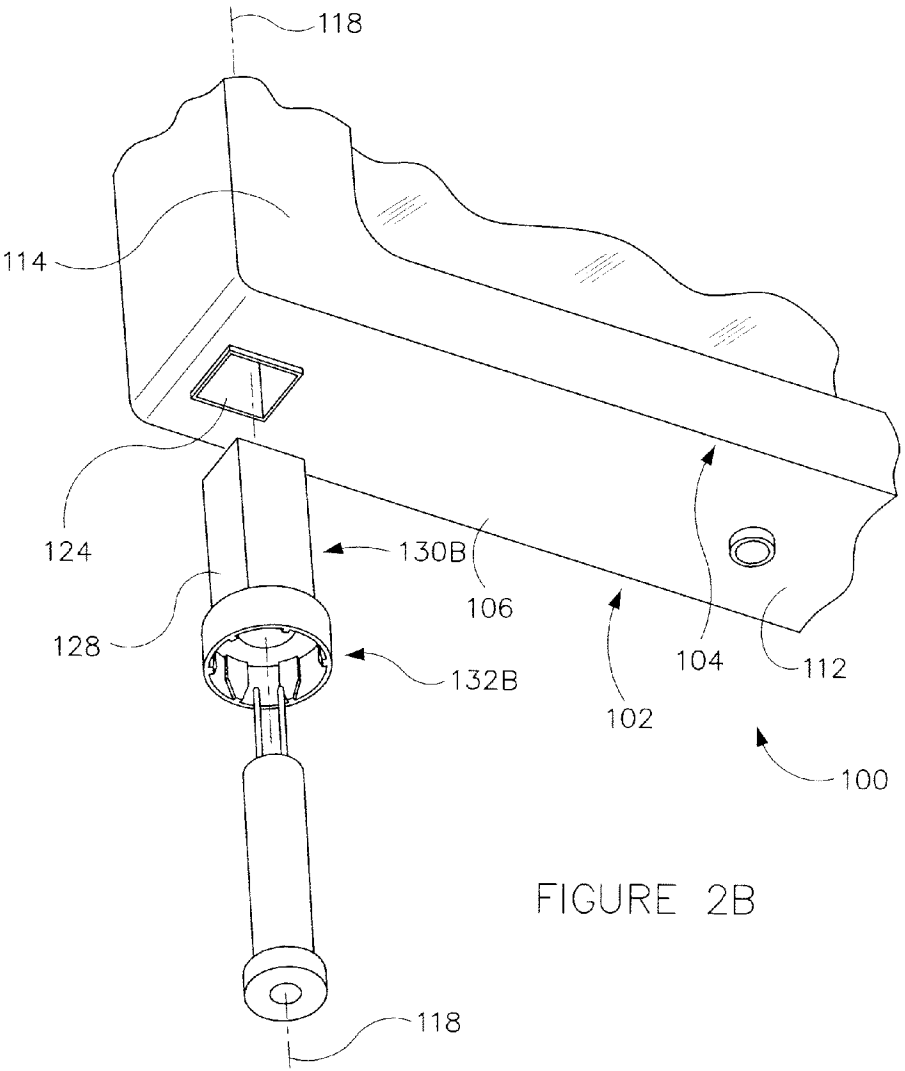
FIG. 2B is another partial isometric view of the modular door system according to the exemplary embodiment of FIG. 1.

Referring to FIGS. 2A and 2B, each modular door system 100 includes one or more receptacles, shown as first receptacle 122 and a second receptacle 124, and one or more cartridges, shown as a first cartridge 126 and a second cartridge 128, according to an exemplary embodiment. The receptacles 122, 124 and the cartridges 126, 128 are configured to provide for post-formation customization of the modular door system 100. The cartridges 126, 128 are removably receivable within the receptacles 122, 124 and coupled to the refrigerated case frame 16. The cartridges may include different features and thereby provide different functionalities to the modular door system. Accordingly, by replacing or interchanging the cartridges, the functionality of the modular door system may be changed (e.g., functionalities may be added, functionalities may be removed, functionalities may be changed or switched, etc.), as will be discussed in more detail later. Moreover, the cartridges may be easily replaced or interchanged in the factory or in the field. This ability provides a number of benefits including, but not limited to, helping to avoid difficult and time-consuming replacement of (or repair to) the modular door systems, helping to avoid problems associated with changed circumstances or specifications in the field, allowing modular door systems to be post-mold customized to order, etc.

According to the exemplary embodiment shown, the receptacles 122, 124 and cartridges 126, 128 are shown configured to pivotally couple the modular door system 100 to the refrigerated case frame 16. The receptacles 122, 124 (e.g., recesses, openings, holders, repositories, holes, nooks, etc.) are generally aligned with the pivot axis 118 of the modular door system 100. Each cartridge 126, 128 (e.g., case, unit, etc.) includes a first portion 130A, 130B configured to be received in a receptacle 122, 124 and a second portion 132A, 132B configured to operatively engage the refrigerated case frame 16 at one of a plurality of coupling or receiving features, shown, for example, on the header and on the sill, in a manner allowing the modular door system 100 to be pivotable relative thereto. According to an alternative embodiment, one or more of the coupling or receiving features may be on a mullion or other suitable element. It should be noted that, similar to the configurations of the cartridges, the configurations of the coupling or receiving features of the refrigerated case frame 16 may vary and/or more than one set of coupling or receiving features may be provided for a modular door system. It should also be noted that the coupling or receiving features may have a female or male orientation.

FIGS. 2A and 2B show cartridges 126, 128 disposed in receptacles 122, 124 in a manner providing for the modular door system 100 to have a left-hand orientation. FIG. 2A shows a top, left-hand corner of the modular door system 100 from the exterior (or front as shown in FIG. 1). The first cartridge 126 is shown to be removably received within the first receptacle 122, which is defined generally in the first horizontal frame element 110 of the door frame 106. FIG. 2B shows a bottom, left-hand corner of the modular door system 100 from the exterior. The second cartridge 128 is shown to be removably received within the second receptacle 124, which is defined generally in the second horizontal frame element 112 of the door frame 106. It should be noted that the first portions 130A, 130B of the cartridges 126, 128 are sized and shaped to substantially correspond to the size and shape of the receptacles 122, 124. Typically, the shape of the first portions 130A, 130B of the cartridges 126, 128 is such that the cartridges 126, 128 do not rotate relative to the receptacles 122, 124 once received therein.

The modular door system 100 may be converted from a left-handed orientation, as shown in FIGS. 2A and 2B, to a right-handed orientation by, in no particular order, interchanging the position of the cartridges 126, 128 relative to the receptacles 122, 124 and rotating the modular door system 100 by 180 degrees according to the exemplary embodiment shown. According to one exemplary post-formation conversion process, the modular door system 100 is rotated 180 degrees in a co-planar arrangement such that the exterior side 104 of the modular door system 100 remains facing away from the interior cavity 14 of the refrigerated case 10 when the modular door system 100 is in the closed position after rotation (i.e., is turned "upside down"). Once rotated, the pivot axis 118 is disposed to the right of the handle 120. The cartridges are then interchanged such that the first cartridge 126 is removed from the first receptacle 122 and disposed in the second receptacle 124. Further, the second cartridge 128 is removed from the second receptacle 124 and disposed in the first receptacle 122. The second portions 132A, 132B of the cartridges are then ready to operatively engage the coupling or receiving features of the refrigerated case frame 16 to pivotally couple the modular door system 100 thereto. It should be noted that before rotation, the first horizontal frame element 110 is disposed substantially above the second horizontal frame element 112, and, after rotation, the second horizontal frame element 112 is disposed substantially above the first horizontal frame element 110. According to the illustrated embodiment, the modular door system 100 is released from the refrigerated case frame 16 before rotation and reorientation of the door. To facilitate this release, the cartridges may be configured to be quickly released from the refrigerated case frame 16 (e.g., by releasing the second portion of the first cartridge shown as a spring-loaded pin 134 in FIG. 2A, by any suitable quick-release mechanism, etc.).

In addition to pivotally coupling the modular door system 100 to the refrigerated case frame 16, the receptacles 122, 124 and cartridges 126, 128 may include other features that provide additional functionalities to the modular door system 100. For example, the second cartridge 128 is shown as a coupling device configured to operably transfer the rotational movement of the door to a device configured to limit the rotational movement of the door frame 106 when moved from a closed position to an open position.

According to an alternative embodiment, one or more cartridges may be switched out (e.g., replaced, changed out, etc.). That is, a cartridge may be removed from a receptacle and another, different cartridge may be positioned in that receptacle. According to one alternative embodiment, a cartridge may be switched and replaced with another cartridge of the same configuration (e.g., if the cartridge being replaced is worn out, etc.). According to another alternative embodiment, a cartridge having a first configuration may be switched out and replaced with a cartridge having a second, different configuration. For example, the first cartridge may be replaced with a cartridge including a release mechanism other than a spring-loaded pin.

According to an alternative embodiment, the coupling features of the refrigerated case frame on one side of the opening (e.g., the left-hand-side) that are configured to receive a modular door system may differ from the coupling features on the other side (e.g., the right-hand-side). Replacing the cartridges provides a way to change the corresponding coupling features of the modular door system. For example, the cartridges configured to engage the first set of coupling features may be replaced by a second set of coupling features configured to engage the second set of coupling features.

According to an alternative embodiment, elements other than the cartridges may be used to pivotally couple the modular door system to the refrigerated case frame. For example, a quick-release feature may be integrally formed with the modular door system at one end of the door and a cartridge may be disposed in a receptacle at another end of the door. Together, the quick-release feature and the cartridge may be configured to pivotally couple the modular door system to the refrigerated case frame.

According to an alternative embodiment, the modular door system may include more than two cartridges and more than two receptacles.

Figure 3:
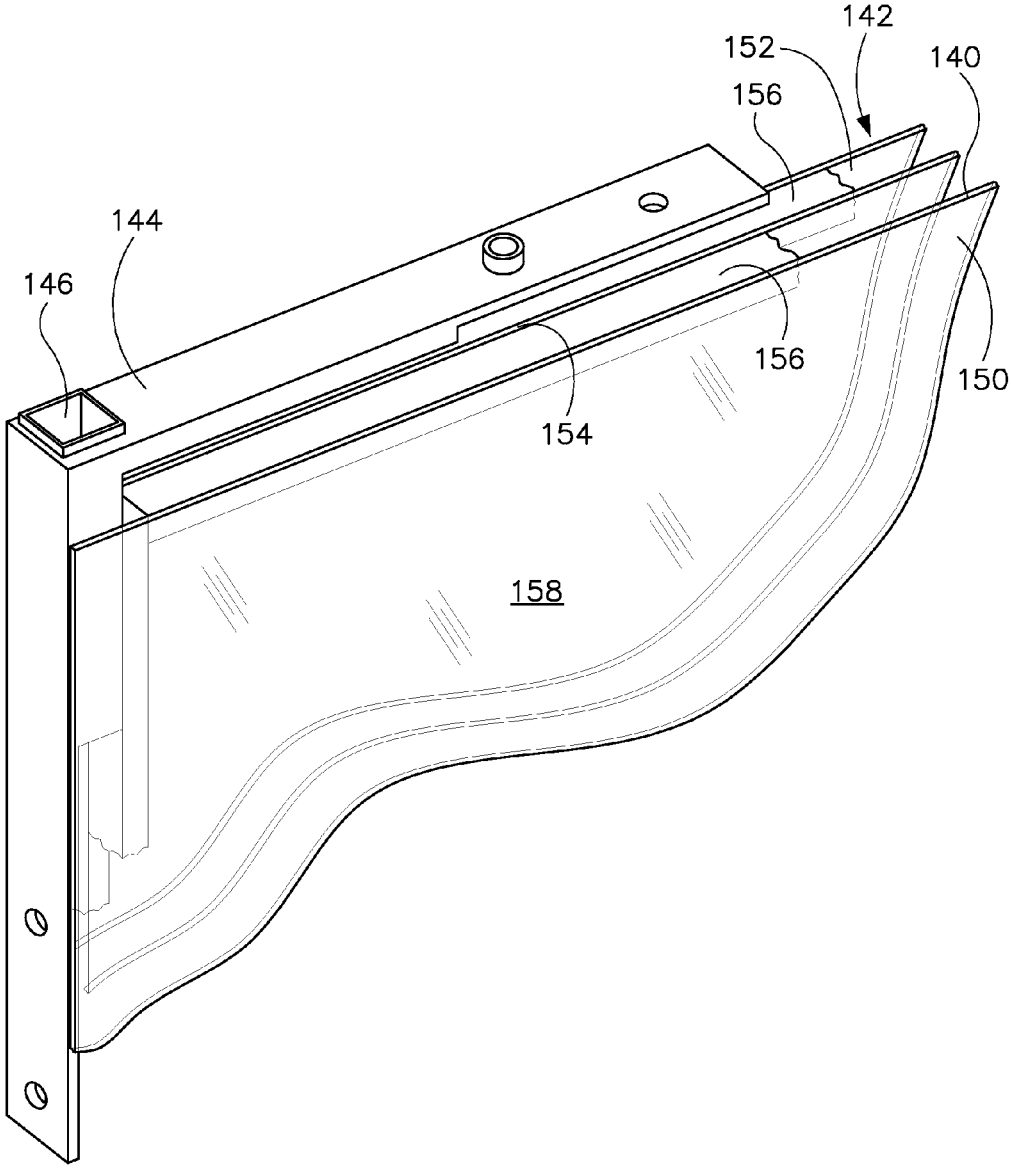
FIG. 3 is another partial isometric view of the modular doors system according to the exemplary embodiment of FIG. 1 with the frame removed for clarity.

In the exemplary embodiment shown in FIGS. 1-3, the modular door system 100 is shown having a door frame 106 that is a seamless, one-piece, polymer frame molded to extend about a perimeter 140 of at least one transparent panel, shown as a glass unit 142. According to one embodiment, this door frame 106 is formed using an injection molding process, which will be discussed in more detail below.

FIG. 3 shows the modular door system 100 with the door frame 106 removed for clarity. A bracket 144 is disposed at each corner of the glass unit 142 that corresponds to a corner of the modular door system 100 having one of receptacles 122, 124 according to an exemplary embodiment. The brackets 144 are configured to help define and provide structure for the receptacles 122, 124 as well as to help support the cartridges 126, 128 received in the receptacles 122, 124. Each bracket 144 includes a bracket receptacle 146 substantially corresponding to and at least partially defining one of receptacles 122, 124 of the modular door system 100. The brackets 144, and, accordingly, the receptacles 122, 124, are substantially fixed in a desired position when the door frame 106 is molded about the glass unit 142. It should be noted that, in the illustrated embodiment, the brackets 144 are shown further including a hole or bushing that is configured to receive an electrical connector for the glass unit, and the brackets 144 are configured to provide an anchor for a door hold open device. While the bracket 144 is shown as an L-shaped bracket, brackets or other support structures of other sizes, shapes, and configurations suitable for helping to define and provide structure for the receptacles may be used.

Figure 4:
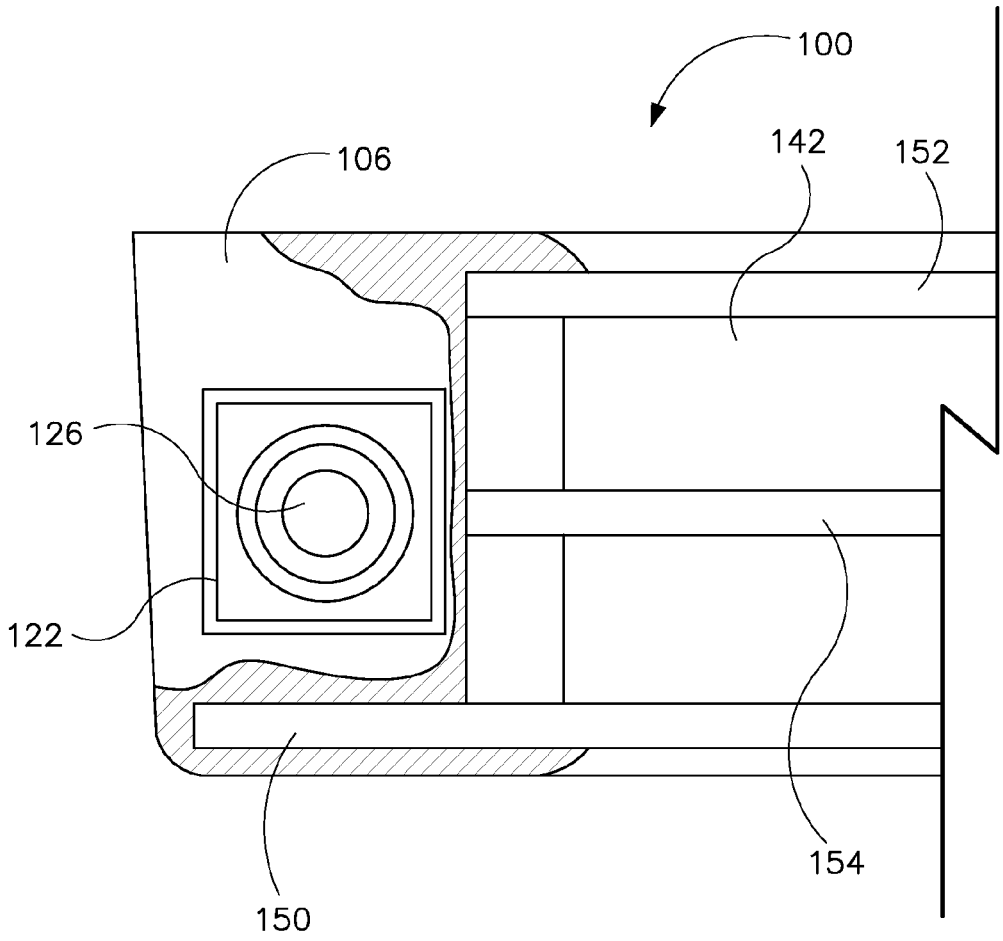
FIG. 4 is a partial, top plan view of the modular door system according to the exemplary embodiment shown in FIG. 1 with the location of a glass unit indicated.

Referring to FIGS. 3 and 4, the glass unit 142 is shown stepped and insulated, having a first glass panel 150 spaced apart and parallel to a second glass panel 152. The first glass panel 150 generally defines the exterior side of the modular door system 100 and is larger than the second glass panel 152 according to an exemplary embodiment. In the exemplary embodiment shown, a third glass panel 154 is provided in addition to and substantially between the first glass panel 150 and the second glass panel 152, which may or may not be separated by one or more spacers 156. It should be noted that the brackets 144 are shown disposed generally behind or interior to the first glass panel 150 to help conceal the brackets 144 as well as the cartridges 126, 128 and receptacles 122, 124. Further, positioning the larger, first glass panel to the exterior of the modular door system helps insulate the modular door system 100, helping the modular door system 100 to retain the cool air within the interior cavity 14 of the refrigerated case.

According to an alternative embodiment, the glass panels generally defining the interior and the exterior of the modular door system may be larger than the intermediate glass panels of the glass unit disposed therebetween. According to some exemplary embodiments, the number of glass panels in the stepped glass unit may differ from the number shown (e.g., the stepped glass unit may include two glass panels, four glass panels, etc.). According to some exemplary embodiments, the glass unit is not a stepped glass unit or an insulated glass unit. According to other exemplary embodiments, the panels are made of transparent materials other than glass. According to one exemplary embodiment of implementing a left-hand/right-hand conversion of this alternative embodiment (or similar alternative embodiments), the modular door system may be rotated 180 degrees in a manner resulting in the exterior side of the door facing the interior cavity of the refrigerated case (i.e., "inside-out").

Figure 5:
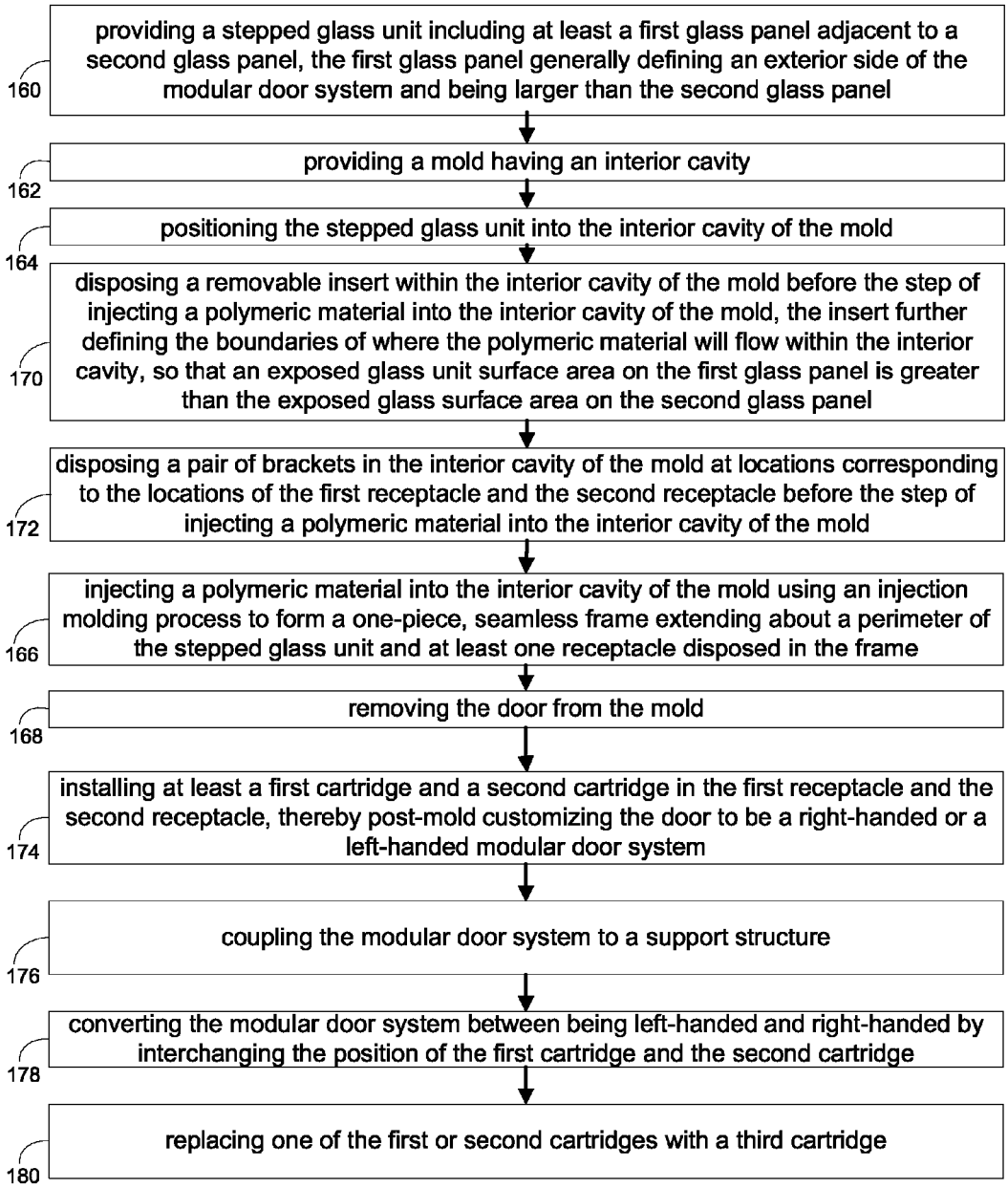
FIG. 5 is a flow diagram of a method of making a modular door system according to an exemplary embodiment.

Referring to FIG. 5, an exemplary modular door system formation process will be discussed by way of example, and not by way of limitation. The stepped glass unit 142 is provided in a step 160. The stepped glass unit 142, as described above, includes at least first glass 150 panel spaced apart and parallel to a second glass panel 152, the first glass panel 150 generally defining the exterior side of the modular door system 100 and being larger than the second glass panel 152. A mold having an interior cavity is also provided in a step 162. The glass unit 142 is positioned (e.g., disposed, inserted, etc.) into the interior cavity of the mold in a step 164. In a step 166, a polymeric material is injected into the interior cavity of the mold using an injection molding process (e.g., a reaction injection molding process, a low-pressure injection molding process, etc.) to form a one-piece, seamless frame extending about the perimeter of the glass unit 142 and at least one receptacle (e.g., the first receptacle 122 and the second receptacle 124, etc.) disposed in the door frame 106. The door is removed from the mold in a step 168.

In the exemplary embodiment discussed, the injection molding process is a low pressure injection molding process that utilizes a pressure less than approximately 100 psi. According to one exemplary embodiment, the low pressure injection molding process utilizes a pressure of approximately 50 psi. Utilizing relatively low pressures to perform the injection molding process provides a number of benefits, including preventing damage to the glass unit during formation.

In the exemplary embodiment shown, the glass of the glass unit 142 is chemically etched (such as with a manual application of an etching chemical, etc.) to help bond the polymeric materials that forms the door frame 106 to the glass unit 142. According to some exemplary embodiments, only a portion of the glass of the glass unit is chemically etched (e.g., the edges, etc.). According to other exemplary embodiments, non-chemically etched glass may be used. According to still other exemplary embodiments, materials other than glass may be used for the transparent panels (e.g., polycarbonate).

In the exemplary embodiment shown, the polymeric material used to form the frame is polyurethane. According to other exemplary embodiments, substantially any polymeric material having a flexural modulus within a range of approximately 12,000 lb/in$^2$ to 20,000 lb/in$^2$ may be used (e.g., 16,000 lb/in$^2$). Using a polymeric material having a flexural modulus generally within this range provides a number of benefits, including that, when the polymeric material cures, it does not generate enough force to crush the glass unit. Polymeric materials are also good insulators (e.g., better than metal components, etc.), and, thus, help to maintain the desired internal temperature of the internal cavity of the refrigerated case by slowing conduction, thereby improve the energy efficiency of the refrigerated case.

Using the above-described process, a "rimless" or "full rimmed" door frame for a modular door system may be formed using the same mold, as will be discussed in more detail below. Both types of frames provide structural rigidity for the glass unit and the modular door system. Further, the door frame of the modular door system may be formed to have a variety of different shapes and sizes.

In the exemplary embodiment shown, the modular door system 100 is shown having a door frame 106 that is a "rimless" frame, as opposed to a more conventional "full rimmed" frame. The "rimless" door frame extends a small distance (e.g., approximately 1/16 inch to 3/16 inch, etc.) over the edges of an exterior 158 of the first glass panel 150. In one exemplary embodiment, the "rimless" door frame extends approximately 1/8 inch over the edges of the exterior of the first glass panel. This slight overlap provides support for the glass unit, yet still provides a sleek, all-glass appearance (e.g. "wall of glass," etc.). It should be noted that the polymeric material (e.g., polyurethane, discussed above) used to form a door frame may be customized. For example, the polymeric material may be colored to correspond to an aesthetic scheme (e.g., of a grocery store, a convenience store, etc.).

To form a "rimless" frame using the above-described formation process, the process may include the additional step 170 of disposing a removable insert within the interior cavity of the mold before the step of injecting a polymeric material into the interior cavity of the mold. The insert further defines the boundaries of where the polymeric material will flow within the interior cavity of the mold, so that an exposed glass unit surface area on the first glass panel is greater than the exposed glass surface area on the second glass panel. In one exemplary embodiment, the insert is substantially rectangular and just slightly smaller than the first glass panel of the glass unit, thereby limiting where the polymeric material can flow in a manner that forms a "rimless" frame. It should be noted, however, that according to alternative exemplary embodiments, the interior cavity of the mold itself may simply be shaped to correspond to the configuration desired frame.

To form a "full rimmed" frame using the above-described formation process, the insert is not provided and is not disposed in the interior cavity of the mold according to an exemplary embodiment. The "full rimmed" door frame extends a greater distance (e.g., approximately 1 1/8 inches to 1 5/16 inches, etc.) over the edges of an exterior 158 of the first glass panel 150 than the "rimless" door frame. Further, the exposed glass unit surface area on the first glass panel is lesser or equal to the exposed glass surface area on the second glass panel. Generally, the "full rimmed" frame extends over the first glass panel of the glass unit so to be intentionally visible and/or visually define the perimeter of the front glass panel. According to another exemplary embodiment, a removable insert may be provided to form a "full rimmed" frame, but the insert is more than just slightly smaller than the first glass panel of the glass unit.

According to an alternative embodiment, the frame may include indicia of a specific customer (e.g., a logo, insignia, a curved portion, etc.). These indicia may be formed, for example, by using a custom insert or a custom mold.

The above-described modular door system formation process further includes a step 172 of disposing a pair of brackets in the interior cavity of the mold at locations corresponding to the locations of the first receptacle and the second receptacle before the step of injecting a polymeric material into the interior cavity of the mold according to an exemplary embodiment. According to other exemplary embodiments, support structures other than brackets may be utilized.

According to an exemplary embodiment, the above-described modular door system formation process may further include a step 174 of installing at least a first cartridge and a second cartridge in the first receptacle and the second receptacle, thereby post-mold customizing the door to be a left-handed or a right-handed modular door system.

The formed modular door system may be converted between being right-handed and left-handed by interchanging the position of the first cartridge and the second cartridge in a step 176 according to an exemplary embodiment. In other steps, the cartridges may be replaced and/or interchanged. For example, in a step 180, one of the first cartridge and the second cartridge is replaced with a third cartridge.

According to an exemplary embodiment, the modular door system may further be coupled to a support structure (e.g., the refrigerated case frame, etc.) in a step 178.

According to an alternative embodiment, the above-described molding process may be used to form a door for a refrigerated case that is a not a modular door as described herein. For example, a door for a refrigerated case may be formed with a rimless, seamless, one-piece frame, but not including receptacles. It should be noted that a door for a refrigerated case including a seamless, one-piece frame as disclosed herein is particularly well-suited for use as a "low-temperature" door for use with a "low-temperature" refrigerated case (e.g., maintaining good stored therein at a temperature approximately within the range of −20° F. to +20° F.).

Though the modular door system is shown as a hinged door, the modular door system could be a sliding door according to an alternative embodiment. Utilizing the above-discussed molding process provides a number of benefits for sliding doors (e.g., those used at deli counters) and other types of doors, including, but not limited to providing improved sanitation (e.g., because there are no seams in which bacteria can harbor).

According to an exemplary embodiment, the frame of a molded door may be configured to receive an insulating gas (e.g., argon, krypton, xenon, etc.).

Referring to FIGS. 6A and 6B, another exemplary embodiment of a modular door system is shown as modular door system 200. The modular door system 200 is not molded like modular door system 100, but, rather, includes a plurality of members 202 (e.g., extruded polymeric, aluminum, etc.) that are mechanically coupled about at least one transparent panel, shown as a glass pack 204, to form the door frame 206. According to one exemplary embodiment, the glass pack is a stepped glass unit similar to stepped glass unit 142.

Similar to the modular door system 100, the modular door system 200 includes a plurality of receptacles, shown as a first receptacle 222 and a second receptacle 224, and a plurality of cartridges, shown as a first cartridge 126 and a second cartridge 128, according to an exemplary embodiment. The receptacles 222, 224 and cartridges 126, 128 provide for the modular door system 200 to be pivotally coupled to a refrigerated case frame and/or to incorporate additional functionalities into the modular door system. Further, as described in more detail above, the cartridges may be interchanged, replaced, and/or have a variety of different configurations. It should be noted that the modular door system 200 is particularly well-suited for use as a medium-temperature door for use with a medium-temperature refrigerated case (e.g., maintaining good stored therein at a temperature approximately within the range of +20° F. to +40° F.).

In the exemplary embodiment shown, the members 202 are "snap-on" extrusions (e.g., aluminum, plastic, etc.) that are configured to be mechanically coupled to the glass pack 204 by having a force applied thereto that "snaps" (e.g., fastens, secures, etc.) them into place.

According to an exemplary embodiment, a kit-of-parts providing for existing doors to be retrofit into modular door systems may be provided. The kit may include one or more brackets or other support elements for defining receptacles and/or supporting cartridges. The kit may also include adaptors suitable for allowing the brackets and/or other elements of the kit to be coupled to the existing door in order to convert it to a modular door system. Additional components of the kit may include, but are not limited to, cartridges, frame-forming members, and fasteners. Once the retrofitting process is complete, the newly modularized door system may be utilized and function in substantially the same manner as any of the embodiments described herein.

According to an exemplary embodiment, a modular door system may be sized to correspond to different sized openings of refrigerated cases. For example, the modular door systems may have a width of 30", 32", or 36" and/or may have a height of 64.5", 68.5", or 75".

According to any exemplary embodiment, a modular door system may be formed by any suitable formation process to include a plurality of receptacles that receive cartridges that provide for functional or other modification (e.g., post-formation conversion) of the modular door system. It should be noted that cartridges may be interchanged among substantially any modular door system having substantially similar receptacles.

According to any exemplary embodiment, a door having a seamless, one-piece frame is molded using an injection molding process. The injection molding process includes providing at least one transparent panel (e.g., a glass unit) and a mold having an interior cavity. The transparent panel is disposed in the interior cavity of the mold. A polymeric material is subsequently injected into the interior cavity of the mold to form a seamless, one-piece frame extending about the perimeter of the at least one transparent panel. In one exemplary embodiment, the frame is a "rimless" frame. In another exemplary embodiment, the frame is a "full rimmed" frame. In some exemplary embodiments, the process may be used to form a "full rimmed" and a "rimless" frame; forming the "rimless" frame may include the additional step of disposing an insert in the interior cavity of the mold.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the molded door system as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A modular door system for a refrigerated case, the refrigerated case having a first set of coupling features of a first configuration for receiving the modular door system in a right hand orientation, and a second set of coupling features of a second configuration, different from the first configuration, for receiving the modular door system in a left hand orientation, comprising:

a stepped glass unit;

a frame extending about a perimeter of the glass unit, the frame including a first horizontal frame element generally opposite a second horizontal frame element, and a first vertical frame element generally opposite a second vertical frame element, the first vertical frame element being configured to pivot about a pivot axis so that the second vertical frame element is movable between an open position and a closed position;

a first receptacle disposed in the first horizontal frame element and a second receptacle disposed in the second horizontal frame element, the receptacles substantially aligned with the pivot axis; and a first set of cartridges removably receivable in the first receptacle and the second receptacle and configured to engage the first set of coupling features in the right hand orientation;

a second set of cartridges removably receivable in the first receptacle and the second receptacle and configured to engage the second set of coupling features in the left hand orientation;

wherein the frame may be converted between the right-handed orientation and the left-handed orientation by rotating the frame 180 degrees and interchanging the first set of cartridges and the second set of cartridges.

2. The modular door system of claim 1, wherein the stepped glass unit and the frame are rotated 180 degrees in a co-planar arrangement.

3. The modular door system of claim 1, wherein the first cartridge and the second cartridge are configured to be pivotably coupled to a support structure of the refrigerated case.

4. The modular door system of claim 1, wherein the stepped glass unit has at least a first glass panel spaced apart and parallel to a second glass panel, the first glass panel generally defining an exterior side of the modular door system and being larger than the second glass panel.

5. The modular door system of claim 4, wherein the modular door system comprises a low-temperature door and the frame is a seamless, one-piece frame molded about a perimeter of the stepped glass unit.

6. The modular door system of claim 1, wherein the modular door system comprises a medium temperature door and the frame includes one or more extruded members mechanically fastened to the stepped glass unit.

7. The modular door system of claim 1, wherein the stepped glass unit is an insulated stepped glass unit.

8. The modular door system of claim 1, wherein the frame is made of polyurethane.

9. The modular door system of claim 1, wherein the frame is made of a material having a flexural modulus within a range of approximately 12,000 $lb/in^2$ to 20,000 $lb/in^2$.

* * * * *